United States Patent [19]

Farris

[11] 4,059,164

[45] Nov. 22, 1977

[54] SELF-STABILIZING DRILLING TOOL

[76] Inventor: Ralph J. Farris, 601 Edwin St., New Iberia, La. 70560

[21] Appl. No.: 687,737

[22] Filed: May 19, 1976

[51] Int. Cl.[2] ..... E21B 41/00; E21B 17/10

[52] U.S. Cl. ..... 175/73; 175/322; 175/325

[58] Field of Search ..... 175/294, 321, 320, 322, 175/73, 67, 325; 166/241

[56] References Cited

U.S. PATENT DOCUMENTS

| | | | |
|---|---|---|---|
| 2,589,534 | 3/1952 | Buttolph | 175/325 |
| 2,625,445 | 1/1953 | Ring | 166/241 |
| 2,715,552 | 8/1955 | Lane | 166/241 X |
| 3,916,998 | 11/1975 | Bass, Jr. et al. | 166/241 |

*Primary Examiner*—Ernest R. Purser

*Assistant Examiner*—William F. Pate, III

*Attorney, Agent, or Firm*—James B. Lake, Jr.

[57] ABSTRACT

A fixed blade assembly rigidly mounted adjacent the oppositely disposed ends of a 7 feet 4 inches of drill pipe with a spinner assembly mounted for rotation and linear movement therebetween. The spinner assembly, randomly rotating and assisting the fixed blade assemblies to center a drill stem in a vertical hole, is stopped by intersecting the side of a drill hole when the drill string starts to deviate from the vertical, and acts as a prize against the side of the drill hole to pry the lower end of the drill string back to vertical and return to random rotation. A jaw-lock assembly is provided between the spinner assembly and the lower fixed blade assembly for wash-over operation should the drill, tool or drill stem stick.

1 Claim, 3 Drawing Figures

SELF-STABILIZING DRILLING TOOL

BACKGROUND OF THE INVENTION

The invention relates generally to well drilling tools and more particularly to self-stabilizing drilling tools, that is tools that drill vertical holes or return to vertical when displaced therefrom.

The invention is an improvement on my prior inventions in the same field on which U.S. Pat. Nos. 3,799,279 and 3,880,246 have been issued. In those patents apparatus and method of using were disclosed for changing the direction of drilling either to deviate from the vertical or bring back to vertical.

In the present invention the conventional bit is kept vertical through minute oscillations provided by the tool acted on by the force of gravity and the application of leverage, while drilling continues.

SUMMARY OF THE INVENTION

An object of the invention is to provide a self-stabilizing drilling tool that will maintain vertical drilling without changing the mode of drilling or stopping the drilling.

Another object of the invention is to provide for wash-over operations in case of the drill stem sticking.

DETAILED DESCRIPTION OF THE INVENTION

Figure 1:
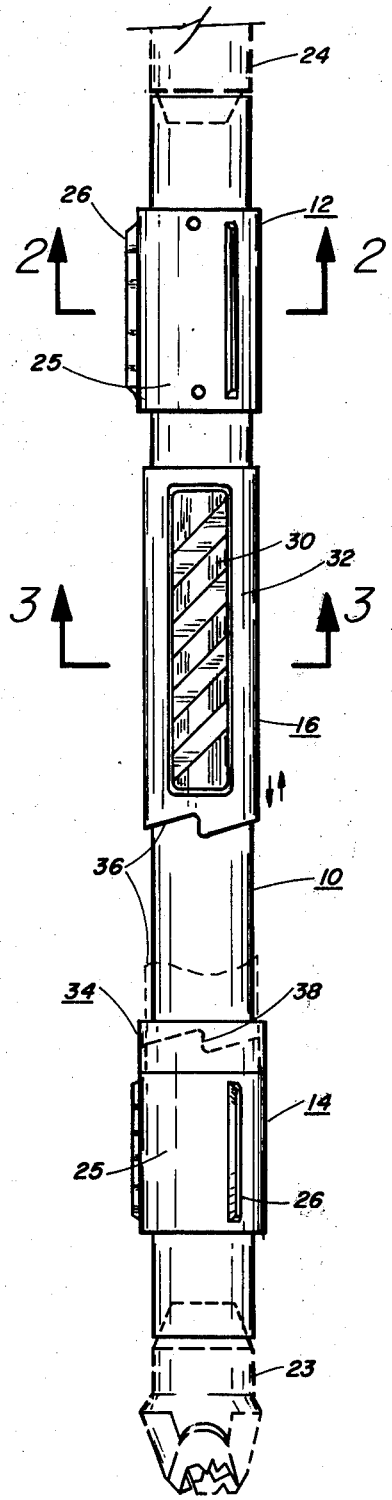
FIG. 1 is an elevational view of the invention.

Referring to FIG. 1, the invention comprises a convenient length of tool body 10, prefereably 7 feet 4 inches, with oppositely disposed ends adjacent to which fixed blade assemblies 12 and 14 are rigidly secured, assembly 12 being bolted in place adjacent an upper end and assembly 14 being welded or integral with tool body 10 adjacent its lower end. A spinner assembly 16 is rotatively and slidably mounted on tool body 10 intermediate said fixed blade assemblies 12 and 14.

The lower end of tool body 10 is tapped to receive a conventional rotational bit 23, and the upper end adjacent blade assembly 12 is threaded to connect with drill stem 24, or as many lengths of tool bodies 10 as may be desired.

Figure 2:
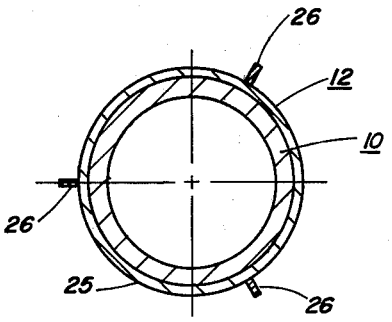
FIG. 2 is a cross-sectional view taken along cross-section lines 2—2 of FIG. 1.

Referring to FIGS. 1 and 2, fixed blade assemblies 12 and 14, each comprise a hub 25 through which tool body 10 is inserted and fixed thereto as shown in FIG. 1. Vertical stabilizers 26 are equally and circumferentially spaced around hub 25, and are preferably three in number spaced 120 degrees apart as shown in FIG. 2.

Hub 25 of the assembly 12 is removable for servicing and replacing spinner assembly 16.

Figure 3:
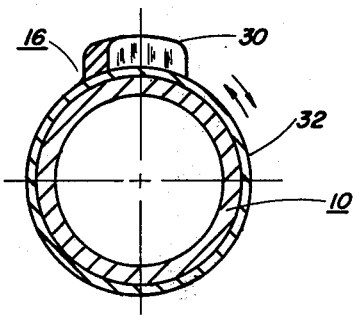
FIG. 3 is a cross-sectional view taken along cross-section lines 3—3 of FIG. 1.

Referring to FIGS. 1 and 3, spinner assembly 16 comprises a single row of five parallel and diagonal positioned blades 30 fixed on hub 32 that is free to turn or rotate and to slide longitudinally on tool body 10 between assemblies 12 and 14, as previously described.

In use, one or more tool bodies and their appurtenances are connected between a drill stem 24 and rotational drill bit 23. In the rotation of the drill stem, tool body 10 is centered in the drill hole by the upper and lower fixed blade assemblies 12 and 14. Spinner assembly 16 is free to turn randomly on the tool body, and as long as drilling is in progress it is forced upward and away from lower blade assembly 14 by a pressure from below of drilling mud that is forced through drill stem 24 and out of drill bit 23 in drilling operations against the larger spinner assembly. If the drill bit 23 leaves the vertical, said spinner assembly stops its random rotation by engaging the drill hole in the direction taken by the drill bit and near the upper fixed blade assembly 12, and as the bit drills deeper, it is wedged between the interferring side of the drill hole and pries the tool body back to vertical assisted by the force of gravity and the weight of the drill stem.

A jawlock assembly 34 comprising a pair of interlocking sleeve parts 36 and 38 are respectively mounted on adjacent ends of spinner assembly 16 and fixed blade assembly 14 for washover operation in case of the drill stem sticking in the drill hole. In such a case, drilling is stopped and the spinner assembly falls by gravity and water pressure from above as water is forced down the drill hole to wash off the drill stem and appurtenances to unstick them.

What is claimed is:

1. A self-stabilizing drilling tool, having a tool body and fixed blade assemblies vertically spaced apart and rigidly secured to said tool body, for connecting in a vertically rotational drill string lubricated with pressure drill mud when drilling a vertical well bore, comprising in combination:

a. a hub mounted for rotation and vertical linear movement on said tool body and intermediate said fixed blade assemblies vertically spaced apart; and b. a plurality of diagonal blades, parallelly positioned to define a single vertical row thereof, fixed to and projecting radially from said hub for vertically lifting and randomly rotating said hub on said tool body, by means of said pressure mud, with said single row of parallel diagonal blades just clearing sides defining said vertical well bore, whereby any deviation from vertical by said drill string engages said row of diagonal blades with a near side of said well bore and pry said drill string back to vertical.

* * * * *